United States Patent [19]

Smith et al.

[11] 4,197,520

[45] Apr. 8, 1980

[54] THERMAL SWITCH DEVICE WITH SPRING CUP CONTACT

[75] Inventors: Dennis D. Smith, Bartlett; Larry L. Sharp, Schaumburg, both of Ill.

[73] Assignee: Illinois Tool Works Inc., Chicago, Ill.

[21] Appl. No.: 953,387

[22] Filed: Oct. 23, 1978

[51] Int. Cl.[2] ..... H01H 37/76

[52] U.S. Cl. ..... 337/407; 337/408

[58] Field of Search ..... 337/404, 407, 408, 409

[56] References Cited

U.S. PATENT DOCUMENTS

| | | | |
|---|---|---|---|
| 661,736 | 11/1900 | Freymann | 337/409 |
| 2,247,902 | 7/1941 | Bahr | 337/404 |
| 2,367,639 | 1/1945 | Conboy | 337/404 |
| 2,516,964 | 8/1950 | Derby et al. | 337/408 X |
| 2,955,179 | 10/1960 | Milton et al. | 337/408 X |
| 3,180,958 | 4/1965 | Merrill | 337/409 |
| 3,956,725 | 5/1976 | Merrill et al. | 337/407 |

*Primary Examiner*—George Harris

*Attorney, Agent, or Firm*—Glenn W. Bowen; Robert W. Beart

[57] ABSTRACT

A thermal switch device is constructed with an electrical conductive spring cup contact that fits over a ceramic insulator which surrounds one lead of the device. The center of the spring cup contact has a pattern cut in it so that it is flexible, and a metallic, thin flat disc which is placed against the surface of the spring cup contact which forces the flexible portions of the spring cup contact into contact with the head of the lead that supports the ceramic insulator. A conductive cup-shaped housing that is open at one end encloses the entire structure and is in contact with the spring cup contact. The outer ends of the housing being pinched over the ceramic insulator at the open end. A second conductive lead is attached to the outer surface of the conductive housing. A pellet made of a thermally-fusible material is inserted between the housing and the metallic disc so that when it melts the disc moves away from the spring cup contact, thereby breaking the circuit between the spring cup contact and the second lead.

7 Claims, 5 Drawing Figures

Fig. 1
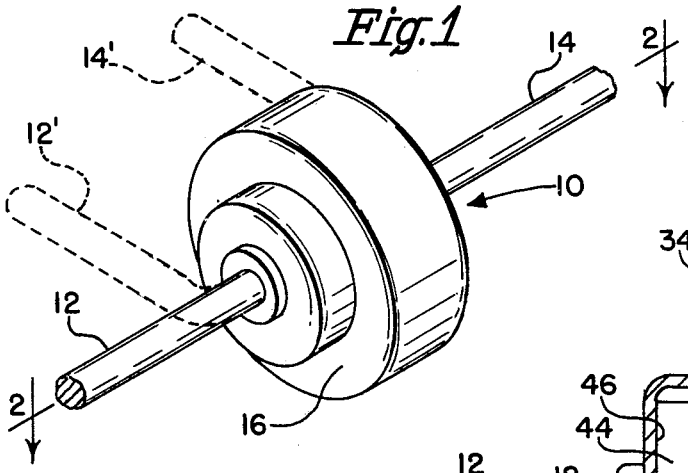
Fig. 2
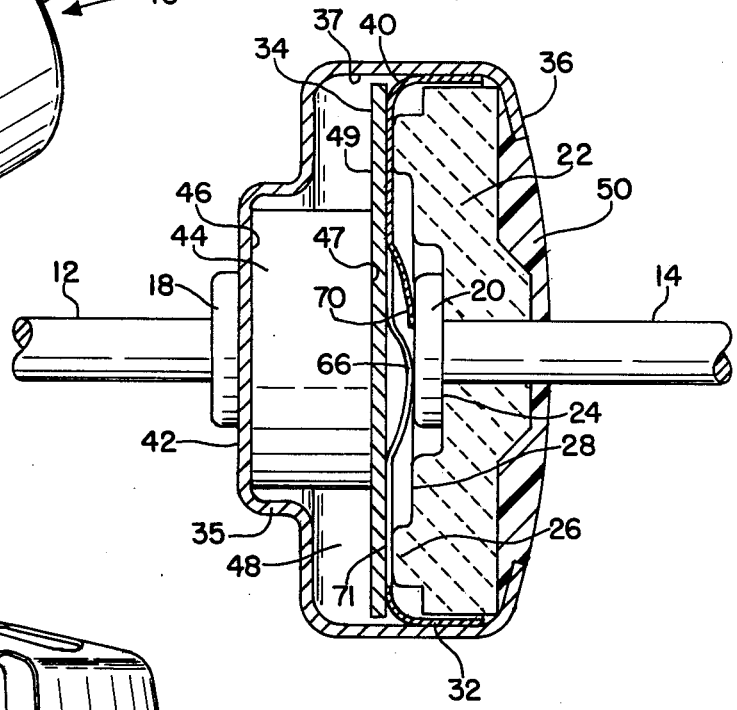
Fig. 3
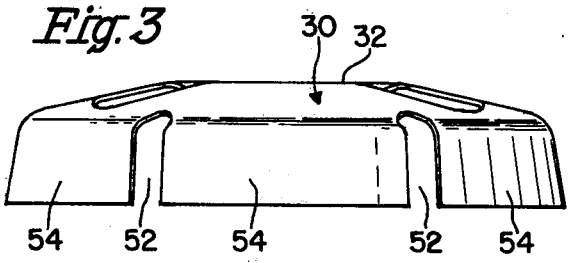
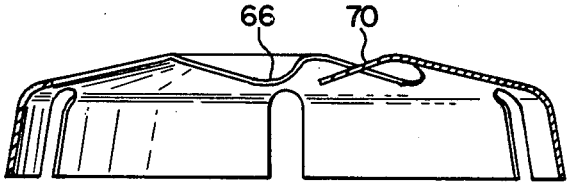
Fig. 5
Fig. 4
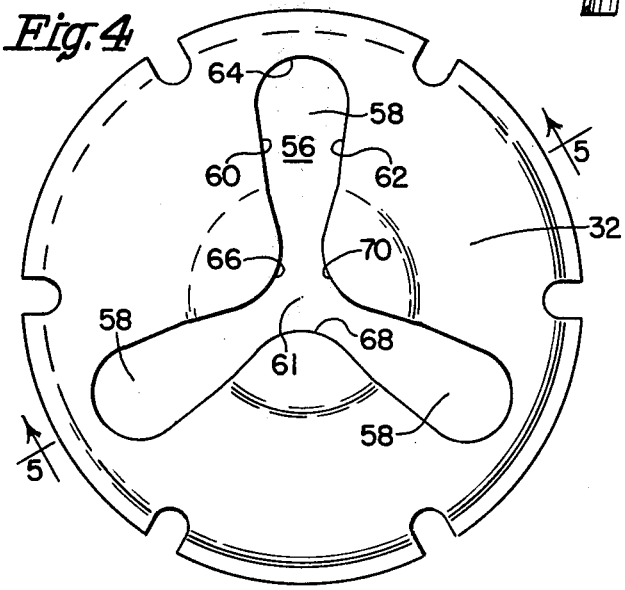

THERMAL SWITCH DEVICE WITH SPRING CUP CONTACT

BACKGROUND OF THE INVENTION

Thermal switching devices are known in the prior art which employ coil springs to achieve the desired switching action upon the melting of a thermally-fusible pellet. Employment of a coil spring in such a device, however, makes the device relatively bulky and expensive to produce since the use of an elongated coil spring requires that the device itself have an elongated housing. In many miniature circuit applications it is extremely desirable to utilize more disclike components, especially if such a shape is accompanied by a reduction in the complexity and the component count of the device.

The present invention provides a thermal switch device which has a disclike shape that is achieved by employment of a conductive cup-shaped spring contact which has the pattern cut into its face so that portions of the cup around the pattern are flexible. The thermally-fusible pellet that is used, which melts at a predetermined temperature, presses against a metallic disc which forces the flexible portions of the electrical spring cup into contact with one of the leads of the device until the pellet melts, when the flexible portions of the spring cup move away from this lead. The housing of the thermal switch is in direct contact with the other lead of the device of the present invention to complete the normally closed circuit. In addition, the fixed-location of the spring cup contact of the present invention is capable of presenting a decided simplification and reduction in both size and cost over prior art moving contact devices. Also the structure of the present invention is simpler, and in construction, uses appreciably fewer parts than these devices.

DESCRIPTION OF THE DRAWINGS

The present invention is described by reference to the drawings in which:

FIG. 1 is an overall perspective view of a thermal cut-off device made in accordance with the present invention;

FIG. 2 is a cross-sectional view of the device of FIG. 1 taken along the lines 2—2 of FIG. 1;

FIG. 3 is a side view of the spring cup member of the thermal device of FIGS. 1 and 2;

FIG. 4 is a top view of the spring cup contact of FIG. 3; and

FIG. 5 is a cross-sectional view of the spring contact cup of FIG. 4 taken along the lines 5—5 of FIG. 4.

TECHNICAL DESCRIPTION OF THE INVENTION

A thermal switch device 10 that is constructed in accordance with the present invention is illustrated in FIG. 1. The device may have axial leads 12, 14 which extend out of the housing 16 of the device. If a radial lead configuration is desired, the axial leads 12, 14 may be bent to the positions shown by the dotted lines, where the leads are represented by 12' and 14'.

The cross-sectional view of FIG. 2 taken along the line of 2—2 of FIG. 1 best illustrates the construction of the thermal switch device of the present invention. The lead 12 has a head 18 on it and the lead 14 has a similar head 20 formed on it. The lead 14 supports a disclike insulator 22, preferably made of ceramic, or other suitable material, which has a recessed front surface 24 that abuts against the rear of the head 20. A circular ring 26 projects forwardly of a surface 28 intermediate the ring 26 and the recessed surface 24. A spring cup member 30, which is also shown in FIGS. 3–5, is placed over the outer periphery 32 of the ceramic insulator 22 so that its rear surface engages the front of the ring 26. A stainless steel disc 34 is positioned against the front surface 32 of the spring cup contact 30.

A cup-shaped housing 35, which is open at one end, is secured to the ceramic insulator 22 by the bent over rim 36 at its open end. The inner surface 37 of the conductive housing 35 therefore contacts the outer surface of the spring cup contact 30 so as to make electrical contact therebetween. The cup-shaped housing 35 has a reduced diameter section 42 into which the thermally-fusible pellet 44 is inserted. The pellet 44 may be made of any of a number of well-known materials which melt at a predetermined temperature. The pellet 44 is inserted so that its front surface 42 abuts against the inner surface 46 of the housing 35 and the rear surface 47 of the pellet 46 abuts against the front surface 49 of the disc 34 which applies an even force on the pellet. The size of the pellet 44 is such that it leaves a large cavity 48 in the housing 35 so that the melted material of the thermally-fusible pellet may flow into this area when the predetermined sensing temperature is reached. The structure is preferably sealed at the rim area 36 of the spring cup contact 30 by means of a suitable seal so formed of epoxy, or cement, or other suitable material. One type of cement that may be used is the Sauersin Cement No. 63 which is available from the Sauersin Cements Company.

The making and breaking of the electrical circuit between the leads 12, 14 is achieved through the flexing action of the spring cup contact 30, the construction of which is best shown in FIGS. 3–5. The spring cup contact 30 is preferably formed with a number of vertically extending slots 52, which are provided to make the side sections 54 more flexible so that the spring contact 30 may more easily be secured over the ceramic insulator 22, as shown in FIG. 2. The front sruface 32 of the spring cup contact 30 has a pattern 56 cut in it which consists of three identical lobes 58, which extend from an open center section 61. Each of the lobes 58 have a pair of outwardly diverging sides 60, 62 which terminate in a semicircular opening 64. It is to be noted that the particular pattern which is shown and described in the drawings may be readily varied by those skilled in the art within the scope of the present invention to achieve the desired function, which is to provide flexibility in the center portion of the spring cup contact 30 so that the center portion of the spring cup contact has the plurality of flexible members which are more readily bent than the remainder of the spring cup contact. The pattern 56 shown in FIG. 4 therefore results in the rounded inner corners 66, 68 and 70 which form a plurality of flexible conductive members. If a cutting line is taken along the lines 5—5 of FIG. 4, the view of FIG. 5 is obtained which shows the flexible corners 66, 70 in the same manner that they are shown in FIG. 2.

With the construction of FIG. 2, it is noted that the metallic disc 34 presses against the front surface 32 of the spring cup contact 30, which would slope upwardly in the absence of such pressure, as shown in FIG. 3. The positioning of the pellet 44 in the housing 35 is such that it forces the disc 34 back against the front surface 32 with enough force to compress the spring cup contact 30 so that the flexible corners 66, 70 and 68 will contact the head 20 of the lead 14, as shown in FIG. 2, to close the circuit between the leads 12, 14 through the spring cup contact 30 and the conductive housing 35. When the predetermined melting temperature of the pellet 44 is reached, the material of the thermal pellet 44 flows into the cavity 48 formed in the housing 35 and the disc 34 will move away from the spring cup contact 30 due to the spring action of the spring cup contact as it attempts to resume its original shape that is shown in FIG. 5. When this occurs, the corners 66, 68, 70 will spring from their deformed shape, as shown in FIG. 2, to their normal unstressed shape, as shown in FIG. 5, thereby breaking the circuit connection between the spring cup contact 30 and the head 20 of the lead 14, and thus thereby breaking the circuit connection through the spring cup contact 30 and the housing 35 to the lead 12. The ring 26 of the insulator 22 presses against the inner front surface 71 of the spring cup contact 30 when contact is made between the corners 66, 68, 70 so that the ring 26 in effect acts as a fulcrum surface for the flexible corners of the spring cup contact 30 when the circuit between the leads 12, 14 is initially closed, thereby assuring good electrical contact.

What is claimed is:

1. A thermal switch device comprising first and second leads, a generally disc-shaped insulator through which said first one of said leads passes, an electrically conductive cup-shaped housing in contact with said second one of said leads, a springable, cup-shaped electrical element supported by said first insulator and inserted inside of said housing so as to make electrical contact thereto, said electrical element having a pattern cut into its front surface so as to form at least one flexible conductive member therefrom, a force member pressed against said electrical element so as to deform the shape of said element sufficiently to force said flexible members onto contact with said first lead in a manner that provides a spring action of said flexible members that tends to drive them away from said first lead and a thermally-fusible pellet that melts at a predetermined temperature inserted in said housing between the inner surface of said housing and said force members so as to hold said force member against said electrical element until said thermally-fusible pellet melts, at which time said flexible members will spring away from contact with said first lead thereby breaking the electrical circuit between said first and second leads.

2. A thermal switch device as claimed in claim 1, wherein said disc-shaped insulator has a forward rim which abuts an inner surface of said elment so as to form a fulcrum surface for said flexible members when said thermally-sensitive pellet is solid and the electrical circuit between said first and second leads is closed.

3. A thermal switch device as claimed in claim 1, wherein said housing is open-ended at one end and has a rim at said open end which is bent over said disc-shaped insulator to secure said housing to said insulator.

4. A thermal switch device as claimed in claim 3, wherein said insulator has a forward rim which abuts an inner surface of said element so as to form a fulcrum surface for said flexible members when said thermally-sensitive pellet is solid and the electrical circuit between said first and second leads is closed and said force member is a thin, flat disc.

5. A thermal switch device comprising first and second leads, a conductive housing in electrical contact with one of said leads, a fixed-location element in electrical contact with said housing and having a flexible portion that is deflectable under force into contact with the other of said leads, but which will spring away from said contact with said other lead when said force is removed, a force member initially forced toward said flexible portion of said element for deflecting said flexible portion into contact with said other lead and a thermally-fusible pellet located between said housing and force member so as to hold said force member in its initial position so that said flexible portion of said element will complete the electrical circuit between said leads when said pellet is in a solid form, said pellet being meltable so as to flow in said housing upon the reaching of a predetermined temperature which allows said force member to move and thereby release said deflecting force upon said flexible portions, which in turn breaks the circuit between said leads due to the springing of said flexible portion away from said other lead with the contact areas between said housing and said element remaining fixed regardless of the position of said flexible portion.

6. A thermal switch device as claimed in claim 5 wherein said element is cup-shaped and said flexible portion is formed by a pattern cut into a surface of said element which contacts force member.

7. A thermal switch as claimed in claim 6, wherein electrical contact between said housing and said cup-shaped element is obtained through an outer portion of said element and said pattern is provided in the center of said surface of said element which contacts said force member.

* * * * *